United States Patent [19]

Römmen et al.

[11] Patent Number: 4,510,783

[45] Date of Patent: Apr. 16, 1985

[54] CHANGING ROLLS IN SIX-HIGH ROLL STAND

[75] Inventors: Hans Römmen, Dormangen; Hans Frosch, Neuss, both of Fed. Rep. of Germany

[73] Assignee: SMS-Schloemann Siemag AG, Düsseldorf, Fed. Rep. of Germany

[21] Appl. No.: 555,458

[22] Filed: Nov. 28, 1983

[30] Foreign Application Priority Data

Nov. 30, 1982 [DE] Fed. Rep. of Germany ..... 3244200

[51] Int. Cl.[3] ..... B21B 28/00; B21B 31/10

[52] U.S. Cl. ..... 72/200; 72/239

[58] Field of Search ..... 72/239, 238, 237, 200

[56] References Cited

U.S. PATENT DOCUMENTS 3,638,468 2/1972 Fukui et al. ..... 72/239 X 4,435,970 3/1984 Sekiya et al. ..... 72/239

FOREIGN PATENT DOCUMENTS 7602387 4/1975 Brazil .

3123933 2/1982 Fed. Rep. of Germany .

84108 7/1981 Japan ..... 72/239

*Primary Examiner*—Lowell A. Larson

*Assistant Examiner*—Steven B. Katz

*Attorney, Agent, or Firm*—Karl F. Ross; Herbert Dubno

[57] ABSTRACT

A changing apparatus for a standard six-high rolling stand comprises a changing carriage having a pair of similar full-set holders each provided with two vertically spaced working-roll supports and two vertically spaced backup-roll supports flanking the respective working-roll supports. These supports are vertically spaced like the respective rolls in the stand. Thus a full set of two working and two backup rolls can be held in either of the holders. The changing carriage can be displaced between upstream and downstream positions to axially align with the rolls in the stand. A loading carriage has a working-roll holder with two vertically spaced working-roll supports and a backup-roll holder with two vertically spaced backup-roll supports, the carriage being displaceable into a position with the working-roll supports of the working-roll holder aligned with the working-roll supports of one of the full-set holders and a position with the backup-roll supports of the backup-roll holder aligned with the backup-roll supports of the one full-set holder. The rolls can be axially shifted from the loading carriage holders into the one full-set holder, rolls are then axially shifted from the stand into the other full-set holder, and rolls in the one full-set holder are shifted into the roll stand.

11 Claims, 3 Drawing Figures

CHANGING ROLLS IN SIX-HIGH ROLL STAND

FIELD OF THE INVENTION

The present invention relates to a method of and apparatus for changing rolls in a roll stand. More particularly this invention concerns such a system used in a six-high roll stand.

BACKGROUND OF THE INVENTION

A standard six-high rolling stand of the type used for rolling strip steel has a pair of vertically spaced nip-defining working rolls of relatively small diameter. Respective upper and lower inner backup rolls of larger diameter bear respectively down and up toward the nip on the respective working rolls, and respective upper and lower outer backup rolls of still larger diameter bear toward the nip on the respective inner backup rolls. Thus the bendability of the small-diameter working rolls is largely canceled out by the rigidity of the larger-diameter backup rolls so that the large forces required for rolling can be brought to bear on the workpiece.

In copending patent application No. 352,520 filed Feb. 26, 1982 a rolling stand is disclosed comprising a frame in which upper and lower working rolls are journaled for rotation about respective parallel upper and lower working-roll axes and define a workpiece nip. Respective upper and lower backup-roll guide elements vertically flank the working rolls and are each at least partially vertically displaceable relative to the frame. Respective upper and lower backup-roll journal blocks are axially displaceable but vertically fixed relative to the guide elements and define parallel upper and lower inner axes flanking the working axes. Respective inner backup rolls are journaled in the blocks for rotation about the inner axes and bear radially toward the nip on the working rolls. The inner backup rolls are therefore axially displaceable in the guide elements. A pair of outer backup rolls are journaled in the frame for rotation about outer axes coplanar with the respective-inner axes and bear radially toward the nip on the inner backup rolls. Means is provided including respective vertically effective actuators for exerting a force at least generally parallel to the planes between each journal block and the frame to bend the inner backup rolls and for displacing the force axially relative to the journal blocks.

In such arrangements it is necessary to change the working rolls and the inner pair of backup rolls periodically. These elements are normally of relatively small diameter and wear rather rapidly. Typically they are permanently mounted in their journal blocks, and once worn or scored are removed with their journal blocks and taken to a shop where the rolls are turned down. Obviously this machining is such a time-consuming process that a spare set of rolls is kept near the roll stand so they can be alternated in the stand with the other set.

Brazilian patent document No. 7,602,387 filed by Noriyoshi Sonobe with a claim to a Japanese priority date of Apr. 12, 1975 describes a roll-changing system for such an arrangement which has a changing carriage that can move both in a transverse direction extending horizontally perpendicular to the workpiece travel direction and parallel to the roll axes and a longitudinal direction extending horizontally parallel to the workpiece travel direction. This carriage has two adjacent holders for two sets of rolls, each holder being shaped to hold a full set of rolls in a stack, with the two working rolls vertically superposed and vertically flanked by two backup rolls and with the upper working and backup roll resting on the underlying rolls. Thus a full set of rolls, which here is intended to include two journal blocks for each roll, is held in the one holder, with the roll axes lying in a common vertical plane. In this system the journal blocks for the backup rolls must be smaller than those of the working rolls, measured longitudinally, to allow the above-described stacking.

To use such an arrangement the one holder is loaded up either with a full fresh set of two working and two backup rolls or with a set of working rolls only, as same wear much more rapidly than the backup rolls. The loaded carriage is then pulled up next to the stand whose rolls need replacement. A crane or the like takes the rolls to be replaced off the stand and stacks them in the empty holder, then takes the rolls from the full holder and installs them in the stand.

When the backup rolls are still fairly new it is standard to load the carriage only with a set of working rolls. If the backup rolls wear prematurely, this unreadiness can cause considerable down time while a fresh set of backup rolls is fetched from the shop. Once the backup rolls are old enough to possibly need replacement, the prudent operator keeps a full set of rolls ready for the change, and just replaces all four even if the backup rolls turn out to be reusable. Since the holder directly supports only the lower working and backup rolls, the upper working and backup rolls being supported on the lower ones, it is necessary to unstack the rolls in the holder starting from the top, although independent supporting of the lower working roll makes it possible to load the holder only with two working rolls, the upper of which will be supported on the lower.

German patent document No. 3,123,933 filed by T. Sekiya with a claim to a Japanese priority date of June 18, 1980 has a more complex system that does not put substantial dimension constraints on the journal blocks for the backup rolls, allowing them to be the same size as those of the working rolls. Nonetheless this system is set up so that if one plans to change certain rolls and it is necessary to change more or less, the downtime increases while the carriage is moved about and reloaded. Even when the rolls are pushed axially out of the roll stand into the empty holder and the fresh rolls are pushed axially oppositely back into the stand, this arrangement has little flexibility.

OBJECTS OF THE INVENTION

It is therefore an object of the present invention to provide an improved roll-changing system for a six-high roll stand.

Another object is the provision of such a roll-changing system for a six-high roll stand which overcomes the above-given disadvantages, that is which allows the decision to change the working rolls alone or with the backup rolls to be made at the last minute, with the switchover not lengthened by which way the decision goes.

SUMMARY OF THE INVENTION

A roll stand has a frame, a pair of vertically spaced nip-defining working rolls journaled in the frame for rotation about respective working-roll axes and having axially spaced working-roll journal blocks, respective upper and lower inner backup rolls normally bearing respectively down and up toward the nip on the respective working rolls and journaled in the frame for rotation about respective backup-roll axes and having axially spaced backup-roll journal blocks, and respective upper and lower outer backup rolls bearing toward the nip on the respective inner backup rolls and journaled in the frame for rotation about respective backup-roll axes and having axially spaced backup-roll journal blocks. The axes all normally lie in a common vertical plane. A changing apparatus according to the invention comprises a changing carriage having a pair of similar full-set holders spaced horizontally and perpendicular to the plane and each provided with two vertically spaced working-roll supports and two vertically spaced back-up-roll supports flanking the respective working-roll supports. These supports are vertically spaced like the respective rolls in the stand. Thus a full set of two working and two backup rolls can be held in either of the holders. The changing carriage can be displaced between upstream and downstream positions in each of which a respective one of the holders is axially aligned with the rolls in the stand. A loading carriage has a working-roll holder provided with two vertically spaced working-roll supports and a backup-roll holder provided with two vertically spaced backup-roll supports, the carriage being displaceable into a position with the working-roll supports of the working-roll holder aligned with the working-roll supports of one of the full-set holders and a position with the backup-roll supports of the backup-roll holder aligned with the backup-roll supports of the one full-set holder. The rolls can be axiallly shifted from the holders of the loading carriage into the one full-set holder, rolls are then axially shifted from the stand into the other full-set holder, and rolls in the one full-set holder are shifted into the roll stand.

According to another feature of this invention guide means is provided for horizontal movement of the loading carriage only perpendicular to the axes and for horizontal movement of the changing carriage parallel and perpendicular to the axes. In addition the rolls are held in the respective supports of the respective holders at the same level as they are at in the roll stand. Thus the rolls that need to be changed can be slid axially from the respective supports right into the stand, as the rolls in the stand can be slid out directly into the empty holder.

The holders are horizontally axially open and horizontally axially closed perpendicular to the axes. At least the backup-roll holder of the loading carriage is upwardly open. Thus backup rolls can be lifted out of and dropped into the backup-roll holder. One of the supports of the backup-roll holder of the loading carriage lies above the other support of the backup-roll holder and is provided with means for moving it horizontally into an outer position permitting a backup roll to be lifted up off the underlying support past the upper support, and an inner position preventing such lifting and capable of supporting a backup roll.

Each of the rolls according to this invention carries two axially spaced journal blocks engageable with the respective supports. In fact the rolls rest via their journal blocks on the supports.

For fastest possible changeover the holder of the loading carriage for the working rolls is constituted as a removable cassette. Thus a cassette loaded with two working rolls or with two backup rolls can form the respective holder, making loading the loading carriage very easy. The upper holder of this cassette can, of course, also be provided with movable holders so the rolls can be dropped down into it. Such an arrangement is particularly useful with a heating means that preheats the working rolls adjacent the roll stand.

The method according to this invention therefore comprises the steps of first loading a full set of two fresh inner working and two fresh backup rolls into the respective supports of the loading carriage and normally keeping the thus loaded loading carriage adjacent the roll stand. One of the holders of the loaded loading carriage is axially aligned with one of the holders of the changing carriage and the rolls are transferred from the respective supports of the one loading-carriage holder to the respective supports of the one changing-carriage holder. Then the other of the holders of the now half unloaded loading carriage is aligned with the one changing-carriage holder and the rolls are transferred from the respective supports of the other loading-carriage holder to the respective supports of the one changing-carriage holder. The other changing-carriage holder is aligned then with the roll stand and the two working rolls and the two backup rolls are axially displaced therefrom into the respective supports of the other changing-carriage holder, although this step can take place even before the other holder of the changing carriage is loaded. Finally the one changing-carriage holder is aligned with the roll stand and the rolls are displaced therefrom into the roll stand.

More particularly, according to the method of this invention, once the loading carriage is fully loaded the machine operator ascertains which of the rolls of the roll stand need replacement, something which is typically done by visual inspection of the rolls themselves or of the workpiece downstream of the stand in question. Fresh rolls corresponding to those needing replacement are then transferred from the supports of the loaded loading carriage to the resepective supports of one of the holders of the changing carriage and the unneeded rolls, if any, in the loading carriage can be just left there. Thereafter those rolls in the stand needing replacement are transferred to the respective supports of the other holder of the changing carriage. Then the one changing-carriage holder is aligned with the roll stand and the rolls are displaced therefrom into the roll stand.

DESCRIPTION OF THE DRAWING

The above and other features and advantages will become more readily apparent from the following, reference being made to the accompanying drawing in which.

SPECIFIC DESCRIPTION

Figure 1:
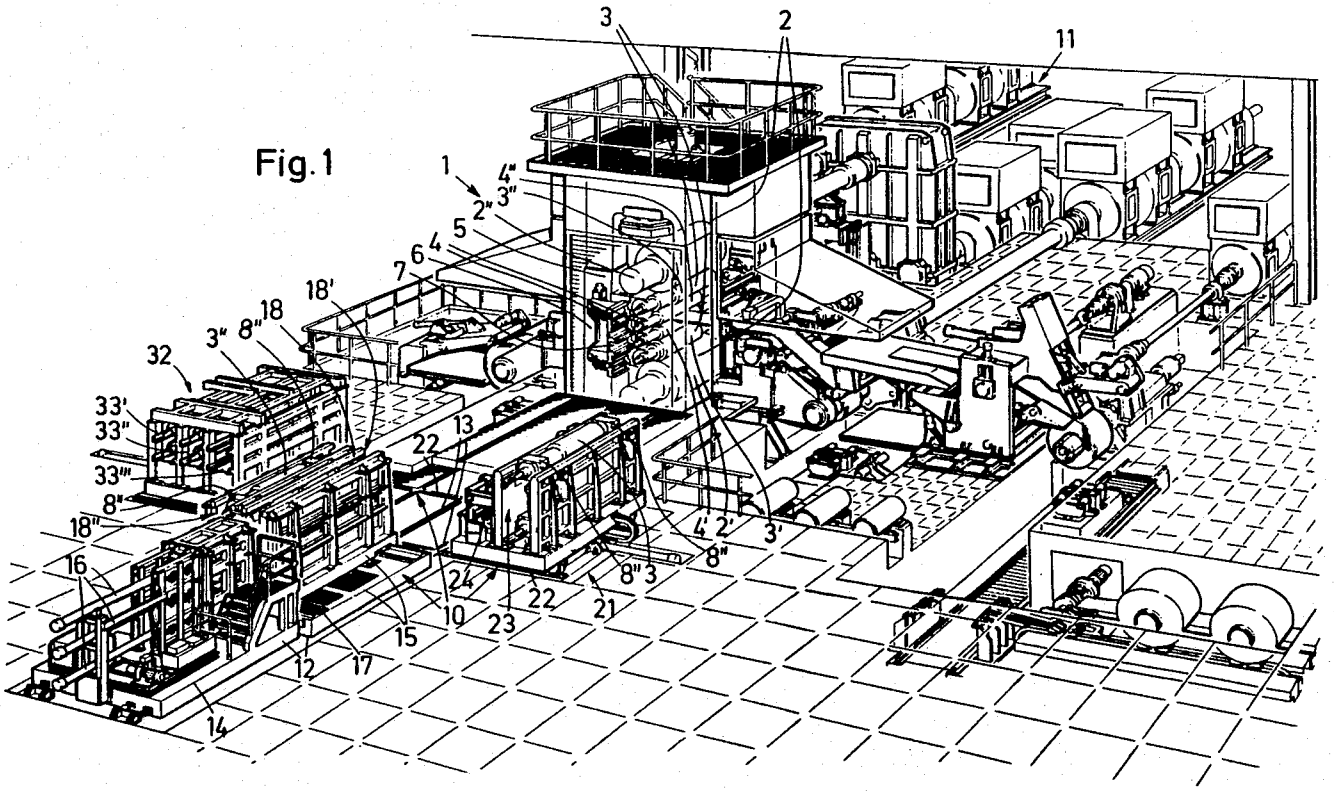
FIG. 1 is a perspective view of a portion of a rolling mill having the roll-changing apparatus according to this invention.

As seen in FIG. 1, a six-high roll stand 1, which may be of the type described in the above-cited U.S. patent application, is of the type used to roll strip steel that passes through it horizontally. This stand 1 has an outer backup-roll pair 2 comprised of two identical large-diameter outer backup rolls 2' and 2'', an inner backup-roll pair 3 comprised of lower and upper inner backup rolls 3' and 3'', and a pair 4 of small-diameter lower and upper working rolls 4' and 4''. Each of these rolls 2' through 4'' is rotatable about a respective horizontal axis that is parallel to the other roll axes and that forms therewith a vertical plane perpendicular to the workpiece travel direction. The stand 1 further has a frame 6 formed with at least one axially or laterally open window 5 through which the rolls 2' through 4' can be withdrawn. Guides 7 are provided on the frame 6 at each side of the window 5 to allow such axial displacement of the rolls. The central working rolls 4' and 4'' wear most rapidly, and the outer backup rolls 2' and 2'' least rapidly.

Figure 2:
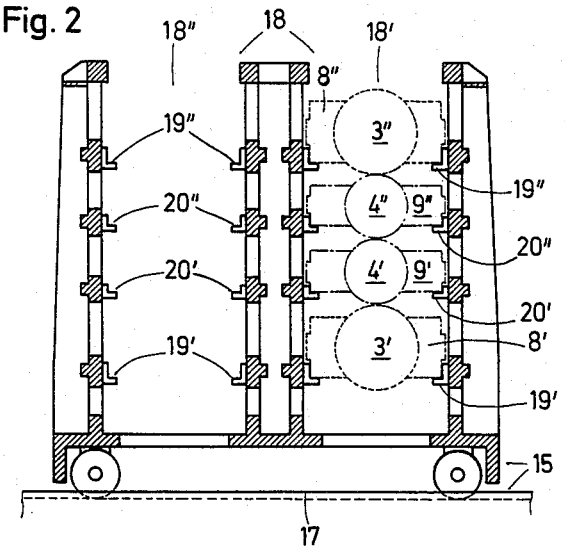
FIGS. 2 and 3 are large-scale end views of two portions of the apparatus of the system of this invention.
Figure 3:
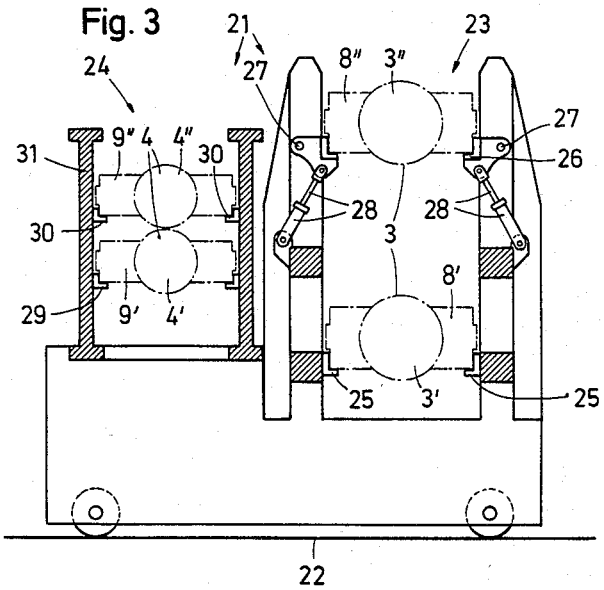

As also shown in FIGS. 2 and 3 the lower and upper inner backup rolls 3' and 3'' are carried on respective journal blocks 8' and 8'' of the lower and upper working rolls 4' and 4''. The far ends of at least the working rolls 4' and 4'' are connected to a drive 11 that rotates them, and other vertically effective actuators such as described in the above-cited U.S. patent application are employed to bias the lower rolls 2', 3', and 4' up and the upper rolls 2'', 3'', and 4'' down.

On the side of the stand 1 opposite the drive 11 is a roll-changing apparatus 11 basically comprising a changing unit 12 displaceable on rails 13 parallel to the roller axes and a loading unit 21. The changing unit 12 basically comprises an outer portion 14 and an inner portion 15, the latter supporting a changing carriage 18. An axially effective roll-moving device 16 that can reach past or through the unit 21 to the stand 1 to engage the rolls 2' through 4'' thereof.

This carriage 18, as seen in FIG. 2, is displaceable on rails 17 of the inner part 15 horizontally perpendicular to the roll axes and comprises identical upstream and downstream holders 18' and 18'' each equipped with lowermost and uppermost support rails 19' and 19'' for the blocks 8 and 8'' of backup rolls 3' and 3'' and inner lower and upper support rails 20' and 20'' for the blocks 9' and 9'' of working rolls 4' and 4''. FIG. 2 shows how these supports 19' through 20'' are vertically positioned so that they can hold a full set of rolls 3' through 4'' in the exact relative vertical position they would assume relative to one another in the stand 1 and in fact at the same vertical level even outside the stand.

As best seen in FIG. 3 the loading unit 21 is basically a carriage supported on the floor on rails 22 extending horizontally parallel to the workpiece travel direction through the stand 1. This unit or carriage 21 has an upstream backup-roll holder 23 and a downstream working roll holder 24, either of which can be aligned parallel to the roll axes with the holder 18' and 18''.

The backup roll holder 23 is provided with lower stationary support rails 25 on which the journal block 8' of a lower backup roll 3' can sit, to permit this roll 3' to be slid axially into and out of the holder 23. In addition upper rails 26 are pivoted at 27 on the holder 23 and are controlled by small cylinders 28 so that they can swing between the illustrated raised position and a lower position. In the raised position they can support the blocks 3'' of an upper backup roll 3'' at the same horizontal level it has in the holder 18', in the holder 8'', or in the stand 1. In the lowered position it is possible for a crane to drop a lower backup roll 3' with its blocks 8' down into the upwardly open holder 23 onto the lower supports therein.

The holder 24 is formed as a removable cassette 31 and is formed with lower and upper supports 29 and 30 for the blocks 9' and 9'' of lower and upper working rolls 4' and 4''. Once again when supported in the holder 24, the rolls 4' and 4'' are at the same level they are at in the stand 1.

Downstream of the unit 21, that is to the other side of the tracks 13 from the unit 21 is a warming station 32 having three warming stations 33', 33'', and 33''' which are adapted to hold respective working-roll pairs 4 held in cassettes 31. Thus the roll pair 4 can be preheated before being installed in the stand 1.

The system of this invention functions as follows:

First a full set of two fresh inner working rolls 4' and 4'' and two fresh backup rolls 3' and 3'' is loaded into the respective holders 24 and 23 onto the respective supports 25, 27, 29, and 30. A working-roll pair 4 can be lifted directly from the preheater 32 before a changing operation, as usually the working rolls at least are replaced.

One of the holders 23 or 24 of the loaded loading carriage 21 is axially aligned with the holder 18' of the changing carriage 18 and the rolls are transferred from the respective supports of the one loading-carriage holder 23 or 24 to the respective supports of the one changing-carriage holder 18'. Then the other of the holders 23 or 24 of the now only half loaded loading carriage 21 is aligned with the same changing-carriage holded 18' and the rolls are transferred from the respective supports of the other loading-carriage holder to the respective supports of the one changing-carriage holder 18'. This leaves the carriage 18 loaded as shown to the right in dashed lines in FIG. 2.

The other changing-carriage holder 18'' is aligned then with the window 5 of the roll stand and the device 16 pulls two working rolls 4' and 4'' and two backup rolls 3' and 3'' needing replacement therefrom into the respective supports of the other changing-carriage holder 18''. Finally the one changing-carriage holder 18' is aligned with the roll stand 1 and the rolls are displaced therefrom into the roll stand 1.

According to this invention the machine operator keeps the loading carriage 21 full, but only decides which rolls to load into the changing carriage 18 when an inspection reveals which rolls need replacement.

With the system of this invention it is possible to replace all four rolls as described above, or only one or two of them. In fact the system of this invention makes it possible to change the inner backup rolls 3' and 3'' alone, something which is done rarely, but which nonetheless is occasionally handy. The loading of the changing carriage 18 takes place very rapidly, using the same axially effective device 16 as is used to pull the old rolls out of the stand 1 and insert the new ones into it, so little extra control technology need be employed as compared to the standard prior-art system.

As mentioned above, it is rare that the working rolls are not replaced, as these rolls wear at a rate much greater than that of the backup rolls, being smaller and in direct contact with the workpiece. The system of this invention therefore makes it possible to load an effectively preheated set of working rolls into the loading unit 21 immediately before unloading same into the changing carriage 18. In many instances several such roll pairs 4 will be used up before a single backing-roll pair 3 is, and FIG. 1 shows how there are three pairs 4 in the warming station 32 and another in the unit 21. In addition the holder 24 for the working rolls 4' and 4'' is closer to the carriage 18 than the holder 23, so that normally the carriage 21 need only be pushed through half its normal travel path.

We claim:

1. An apparatus for changing the rolls of a six-high roll stand having:

a frame, a pair of vertically spaced nip-defining working rolls journaled in the frame for rotation about respective working-roll axes and having axially spaced working-roll journal blocks, respective upper and lower inner backup rolls normally bearing respectively down and up toward the nip on the respective working rolls and journaled in the frame for rotation about respective backup-roll axes and having axially spaced backup-roll journal blocks, and respective upper and lower outer backup rolls bearing toward the nip on the respective inner backup rolls and journaled in the frame for rotation about respective backup-roll axes and having axially spaced backup-roll journal blocks, the axes all normally lying in a common vertical plane, the changing apparatus comprising:

a changing carriage having a pair of similar full-set holders spaced horizontally and perpendicular to the plane and each provided with two vertically spaced working-roll supports and two vertically spaced backup-roll supports flanking the respective working-roll supports, the supports being vertically spaced like the respective rolls in the stand, whereby a full set of two working and two backup rolls can be held in either of the holders;

means for displacing the changing carriage between upstream and downstream positions in each of which a respective one of the holders is axially aligned with the rolls in the stand;

a loading carriage having a working-roll holder provided with two vertically spaced working-roll supports and a backup-roll holder provided with two vertically spaced backup-roll supports, the carriage being displaceable into a position with the working-roll supports of the working-roll holder aligned with the working-roll supports of one of the full-set holders and a position with the backup-roll supports of the backup-roll holder aligned with the backup-roll supports of the one full-set holder; and means for axially shifting rolls from the holders of the loading carriage into the one full-set holder, for axially shifting rolls from the stand into the other full-set holder, and for axially shifting the rolls in the one full-set holder into the roll stand.

2. The roll-changing apparatus defined in claim 1, further comprising guide means for horizontal movement of the loading carriage only perpendicular to the axes and for horizontal movement of the changing carriage parallel and perpendicular to the axes.

3. The roll-changing apparatus defined in claim 2 wherein the rolls are held in the respective supports of the respective holders at the same level as they are at in the roll stand.

4. The roll-changing apparatus defined in claim 1 wherein the holders are horizontally axially open and horizontally axially closed perpendicular to the axes.

5. The roll-changing apparatus defined in claim 4 wherein at least the backup-roll holder of the loading carriage is upwardly open, whereby backup rolls can be lifted out of and dropped into the backup-roll holder.

6. The roll-changing apparatus defined in claim 5 wherein one of the supports of the backup-roll holder of the loading carriage lies above the other support of the backup-roll holder and is provided with means for moving it horizontally into an outer position permitting a backup roll to be lifted up off the underlying support past the upper support, and an inner position preventing such lifting and capable of supporting a backup roll.

7. The roll-changing apparatus defined in claim 1 wherein each of the rolls carries two axially spaced journal blocks engageable with the respective supports.

8. The roll-changing apparatus defined in claim 1 wherein the holder of the loading carriage for the working rolls is constituted as a removable cassette.

9. The roll-changing apparatus defined in claim 1, further comprising means for heating working rolls adjacent the roll stand.

10. A method of changing the rolls of a six-high roll stand having:

a frame, a pair of vertically spaced nip-defining working rolls journaled in the frame for rotation about respective working-roll axes and having axially spaced working-roll journal blocks, respective upper and lower inner backup rolls normally bearing respectively down and up toward the nip on the respective working rolls and journaled in the frame for rotation about respective backup-roll axes and having axially spaced backup-roll journal blocks, and respective upper and lower outer backup rolls bearing toward the nip on the respective inner backup rolls and journaled in the frame for rotation about respective backup-roll axes and having axially spaced backup-roll journal blocks, the axes all normally lying in a common vertical plane, the method employing:

a changing carriage having a pair of similar full-set holders spaced horizontally and perpendicular to the plane and each provided with two vertically spaced working-roll supports and two vertically spaced backup-roll supports flanking the respective working-roll supports, the supports being vertically spaced like the respective rolls in the stand; and a loading carriage having a working-roll holder provided with two vertically spaced working-roll supports and a backup-roll holder provided with two vertically spaced backup-roll supports, the vertical spacing of the charging-carriage supports being substantially the same as that of the rolls of the stand; the method comprising the steps of:

(a) loading a full set of two fresh inner working and two fresh backup rolls into the respective supports of the loading carriage and normally keeping the thus loaded loading carriage adjacent the roll stand;

(b) aligning one of the holders of the loaded loading carriage with one of the holders of the changing carriage and transferring the rolls from the respective supports of the one loading-carriage holder to the respective supports of the one changing-carriage holder;

(c) aligning the other of the holders of the loaded loading carriage with the one changing-carriage holder and transferring the rolls from the respective supports of the other loading-carriage holder to the respective supports of the one changing-carriage holder;

(d) aligning the other changing-carriage holder with the roll stand and axially displacing the two working rolls and the two backup rolls therefrom into the respective supports of the other changing-carriage holder; and (e) aligning the one changing-carriage holder with the roll stand and displacing the rolls therefrom into the roll stand.

11. A method of changing the rolls of a six-high roll stand having:

a frame, a pair of vertically spaced nip-defining working rolls journaled in the frame for rotation about respective working-roll axes and having axially spaced working-roll journal blocks, respective upper and lower inner backup rolls normally bearing respectively down and up toward the nip on the respective working rolls and journaled in the frame for rotation about respective backup-roll axes and having axially spaced backup-roll journal blocks, and respective upper and lower outer backup rolls bearing toward the nip on the respective inner backup rolls and journaled in the frame for rotation about respective backup-roll axes and having axially spaced backup-roll journal blocks, the axes all normally lying in a common vertical plane, the method employing:

a changing carriage having a pair of similar full-set holders spaced horizontally and perpendicular to the plane and each provided with two vertically spaced working-roll supports and two vertically spaced backup-roll supports flanking the respective working-roll supports, the supports being vertically spaced like the respective rolls in the stand; and a loading carriage having a working-roll holder provided with two vertically spaced working-roll supports and a backup-roll holder provided with two vertically spaced backup-roll supports, the vertical spacing of the charging-carriage supports being substantially the same as that of the rolls of the stand; the method comprising the steps of:

(a) loading a full set of two fresh inner working and two fresh backup rolls into the respective supports of the loading carriage and normally keeping the thus loaded loading carriage adjacent the roll stand;

(b) ascertaining which of the rolls of the roll stand need replacement;

(c) transferring from the supports of the loaded loading carriage to the respective supports of one of the holders of the changing carriage fresh rolls corresponding to those needing replacement;

(d) transferring to the respective supports of the other holder of the changing carriage from the roll stand those rolls needing replacement; and (e) aligning the one changing-carriage holder with the roll stand and displacing the rolls therefrom into the roll stand.

* * * * *